US006099299A

United States Patent [19]

Raymond et al.

[11] Patent Number: 6,099,299

[45] Date of Patent: Aug. 8, 2000

[54] SUPPORT ATTACHMENT AND CIGARETTE LIGHTER SAFETY DEVICE

[76] Inventors: Lynn Raymond, 8368 Shore Breeze Dr., Las Vegas, Nev. 89128; Chris Raymond, 2388 Wild Ginger, Las Vegas, Nev. 89134; LaRue Birmingham, 741 Amigos Way, #766, Newport Beach, Calif. 92660

[21] Appl. No.: 09/460,220

[22] Filed: Dec. 13, 1999

[51] Int. Cl.[7] ..... F23D 11/36

[52] U.S. Cl. ..... 431/153; 431/146; 220/780; 220/783; 220/787

[58] Field of Search ..... 431/153, 146; 220/780, 783, 787

[56] References Cited

U.S. PATENT DOCUMENTS 3,240,384 3/1966 Lermer ..... 220/780
5,067,895 11/1991 Chuang et al. ..... 431/126
5,435,455 7/1995 Pruss ..... 220/787
6,021,917 2/2000 Lovell et al. ..... 220/780

*Primary Examiner*—Carroll Dority
*Attorney, Agent, or Firm*—Quirk & Tratos

[57] ABSTRACT

A device for removably securing an object having a detent to a support. The support includes having a receiver to receive a portion of the perimeter of the object including the detent. The receiver may be cup-shaped. The support further includes a deformable tab disposed which is received by the detent. The tab may be disposed on a prong and the detent may be disposed on the perimeter of a well where the well is shaped to receive the prong. When engaged, the tab couples to said detent to removably secure the object to said support. The support also includes an actuator engaging the deformable tab to decouple the tab from said detent. The support may optionally be coupled to a key chain or a tether. In a second aspect of the invention, the support receives a portion of the perimeter of a cigarette lighter to secure the cigarette lighter from child-tampering and accidental ignition.

19 Claims, 3 Drawing Sheets

SUPPORT ATTACHMENT AND CIGARETTE LIGHTER SAFETY DEVICE

FIELD OF THE INVENTION

The present invention relates to attachment devices. Specifically, the present invention is a support which may be attached to an object, with one use being the prevention of child tampering and accidental ignition of a cigarette lighter.

BACKGROUND OF THE INVENTION

It is apparent that the number of personal and household objects which people carry with them on a daily basis increases. This leads to a great deal of clutter in a person's belongings. For example, a person may carry a garage door opener, a cigarette lighter, flashlight, pocket knife, keys, cellular telephone, beeper, and the like. With this quantity of devices, it can be difficult to find a particular object, such as one's cigarette lighter, quickly.

Compounding this difficulty is the fact that such objects are becoming smaller. Thus, for example, it may be difficult for a person to quickly and easily locate a garage door opener in one's pocket, gym bag, purse, backpack, or the like when one is carrying a number of small objects.

One device which attempts to address this problem is disclosed in Lewis, U.S. Pat. No. 4,486,169. Lewis discloses a belt holder for a cigarette lighter which includes a tether. However, the drawback of this device is that the holder may be bulky and unwieldy. Moreover, the belt holder looks unattractive. Also, the mechanisms for attaching the lighter to the tether lack release actuators, thus, releasing the cigarette lighter from the device may be difficult.

A problem specific to cigarette lighters is that cigarette lighters can be misused by small children to injure themselves, injure others, or cause property damage. In fact, federal regulations now require that cigarette lighters be childproof. See 16 C.F.R. section 1210. A variety of devices and mechanisms have been created to make cigarette lighters comply with the federal requirements by making cigarette lighters childproof.

For example, many cigarette lighters include stops which prevent the gas lever from being depressed when engaged. Thus, a user must disengage the stop before the cigarette lighter may be used. A drawback of this type of safety mechanism is that the user must remember to reengage the stop after using the cigarette lighter.

An alternate device attempts to address this drawback by providing a stop which is biased in the safety position. In other words, when the stop is released, it automatically returns to the safety position blocking the user from depressing the gas lever. Thus, a user is required to disengage the stop and hold the stop in the disengaged position while using the cigarette lighter, that is, while pivoting the striking wheel and holding the gas lever down. The drawback of such a device is that the user is required to hold the cigarette lighter in an awkward position while using the cigarette lighter. This can greatly increase the risk of the user accidentally injuring himself or herself.

Moreover, such devices are usually designed to be used when the cigarette lighter is in a vertical orientation. Such devices may be much more difficult and dangerous to use if the user holds the cigarette lighter in a horizontal orientation such as to light a campfire, candle, or the like.

Yet another disadvantage of such a device is that the gas port remains uncovered when the stop is engaged. Thus, the lighter may leak fuel from the gas port thereby creating a fire hazard.

Thus, it can be seen that there is a need in the art for a support which may be releaseably secured to an object. There is also a need in the art for a device, which may or may not include a marker, which releaseably attaches to a cigarette lighter to prevent tampering with the cigarette lighter to thereby supplement or replace existing cigarette lighter safety measures.

SUMMARY OF THE INVENTION

The present invention is a device for removably securing an object, such as a cigarette lighter, garage door opener, flashlight, or the like, having at least one detent to a support. The support may, in turn, be attached to something else. For example, the support may be attached to a tether or key chain to facilitate locating the object. The support includes a receiver connected to the support. The receiver may optionally be cup-shaped with a base and side walls.

A deformable tab is disposed on the receiver. When the deformable tab is received by the detent, the tab couples to the detent to removably secure the object to the support. In one optional embodiment, the deformable tab is disposed on a prong extending from the receiver and the detent is a lip disposed on a well in the object shaped to receive the prong. Thus, the receiver may be removably secured to the object by aligning the prong with the well then pressing the support to the object. The deformable tab is deformed to allow the prong to enter the well, then couples to the detent to secure the support to the object. The device further includes an actuator communicating with the deformable tab such that when the actuator is actuated, the tab is deformed thereby decoupling the tab from the detent to release the object from the receiver. In an alternate optional embodiment, the support is coupled to a key chain or tether.

In an alternate aspect of the present invention, the device is intended to secure a safety support on a cigarette lighter to cover the gas lever and, optionally, the gas port of a cigarette lighter to prevent tampering by children or accidental ignition. In this embodiment, a device for removably securing a support to a cigarette lighter having a gas lever, a gas port, and a detent includes a cover. The support includes a receiver. Optionally, the receiver is cup-shaped with a base and side walls.

A deformable tab is disposed on the receiver. When the tab is received by the detent, the tab couples with the detent to secure the support to the cigarette lighter. In an optional embodiment, the tab is disposed on a prong protruding from the receiver and the detent is a lip disposed on the perimeter of a well on the object. The well is shaped to receive the prong. When the prong is inserted fully into the well, the deformable tab engages the detent thereby securing the support to the well over the gas lever. Optionally, the support also covers the gas port. In an optional embodiment, the cover is connected to a tether or key chain.

The device also includes an actuator communicating with the deformable tab. When the actuator is actuated, the deformable tab disengages from the detent to thereby release the cover from the cigarette lighter.

DESCRIPTION

Reference is now made to the figures wherein like parts are referred to by like numerals throughout. Referring to FIGS. 1–5, one aspect of the present invention is a support 10 for removably securing a support 10 to an object 12. Any object 12 could be used. For example, it is contemplated that garage door openers, cigarette lighter 50*s*, flashlights, beepers, and any other small device could be used. The support 10, may, in turn be used to attach the object 12 to something else. For example, the object 12 may be secured to a key chain, key ring, tether, or the like, through the support 10 to facilitate locating the object 12.

Figure 1:
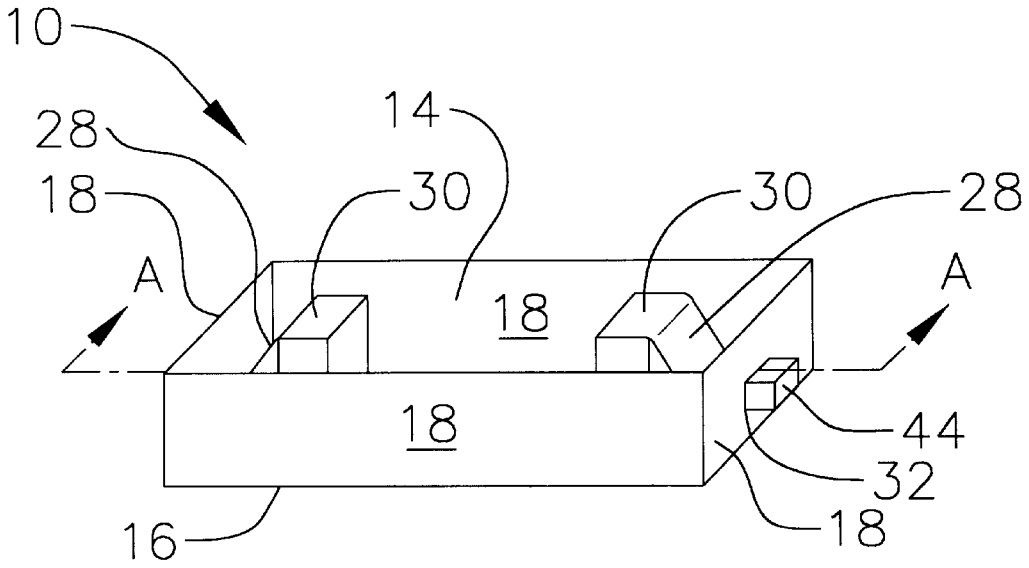
FIG. 1 is an elevated perspective view of an embodiment of the support of the present invention.
Figure 2:
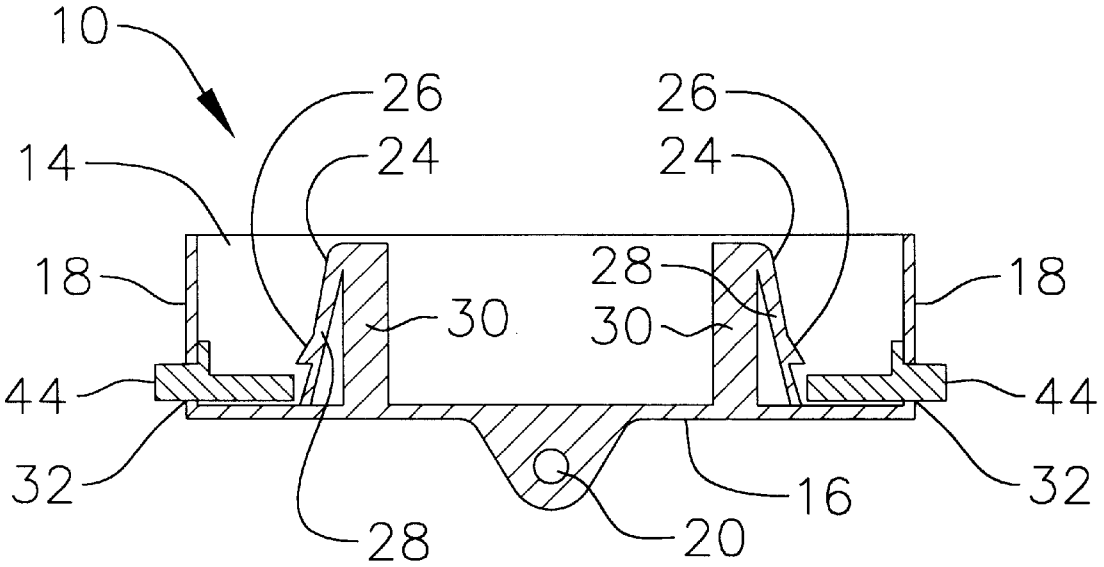
FIG. 2 is an cutaway view of the support according to the embodiment of FIG. 1 taken along line A—A of FIG. 1.
Figure 4:
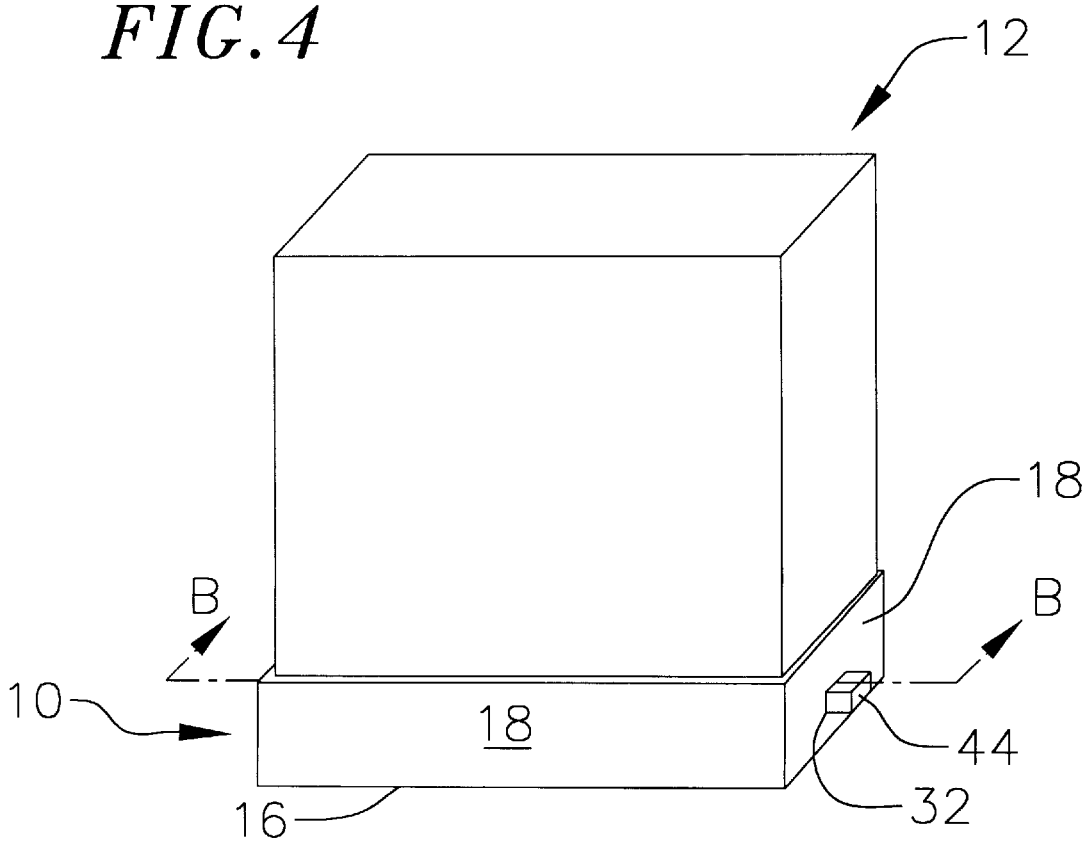
FIG. 4 is an elevated side view of the support of FIG. 1 coupled to the object of FIG. 2.

With reference to FIGS. 1 and 2, the support 10 includes a receiver 14 which engages the object 12. The receiver 14 may be of any shape, such as a flat base 16, but in an optional embodiment, the receiver 14 has a shape complimentary to the surface of the object 12 which it is contacting so that the receiver 14 lies flush when the receiver 14 receives at least a portion of the perimeter of the object 12. Thus, in such an embodiment, a receiver 14 which engages a curved object 12 would include a curved base 16. In a further optional embodiment, the receiver 14 includes a base 16 and side walls 18 to define a substantially cup-shaped receiver 14 to surround and receive at least a portion of the perimeter of the object 12. In this embodiment, as shown in FIG. 4, when the receiver 14 is engaged to the object 12, the object 12 fits into the cup-shaped receiver 14.

Figure 5:
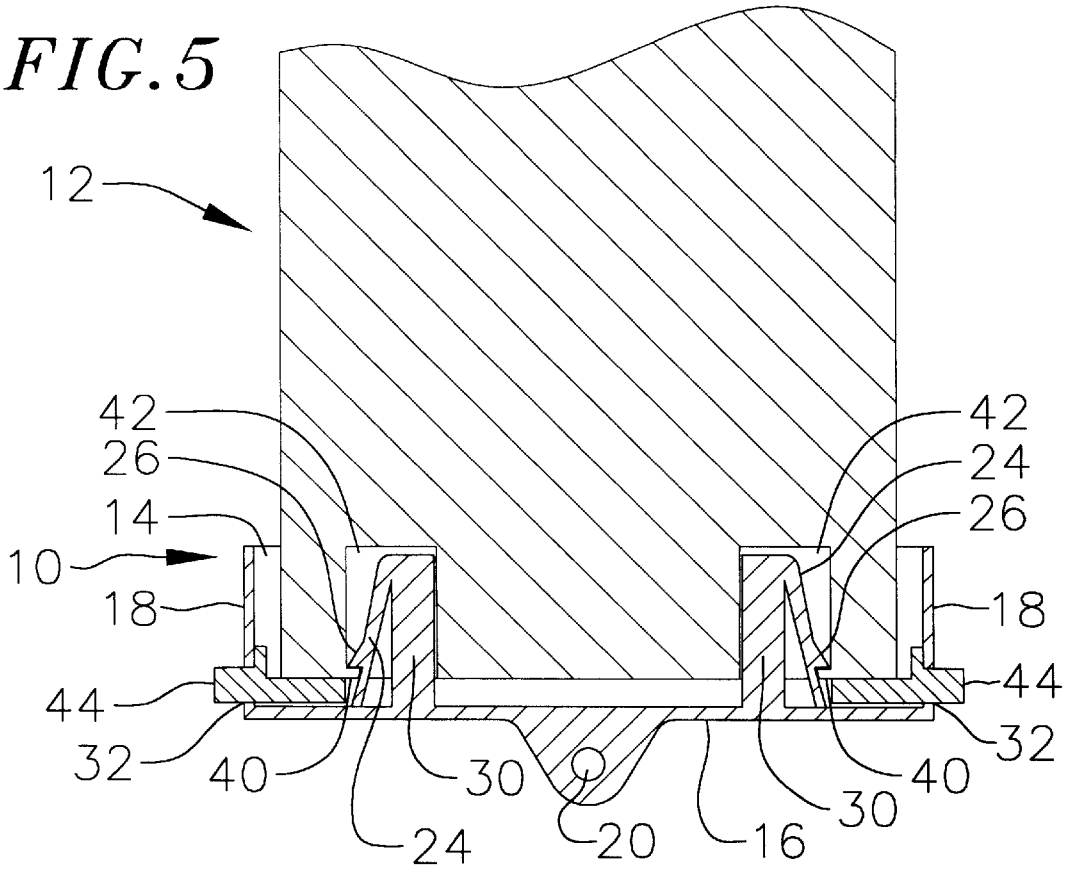
FIG. 5 is a cutaway sectional view of the support of FIG. 1 coupled to the object of FIG. 2 taken along line B—B of FIG. 4.

With reference to FIG. 5, the support 10 may optionally be connected to a fob, tether, key ring, key chain, or the like. Such articles may be connected to the support 10 via an eyelet 20, rivet, link, or may be integrally formed with the support 10.

With continued reference to FIG. 5, the device of the first aspect of the present invention further includes a lock which allows the receiver 14 to be removably secured to the object 12. Any number of locks could be used; the embodiment of FIGS. 1–5 utilizes two locks. One side of the lock is disposed on the receiver 14 and the complimentary side of the lock is disposed on the object 12. As shown in FIGS. 1 and 2, one side of the lock is a deformable tab 24 disposed on the receiver 14. While the deformable tab 24 could take a variety of forms, in one optional embodiment of the present invention, the deformable tab 24 includes a barb 26 disposed at the end of a thin deformable ply 28. The deformable tab 24 is biased outwardly to engage a detent 40 on the object 12 as will be described below. While the deformable tab 24 may be positioned in a variety of ways, in an optional embodiment, the deformable tab 24 is disposed on a prong 30 extending from the receiver 14.

Figure 3:
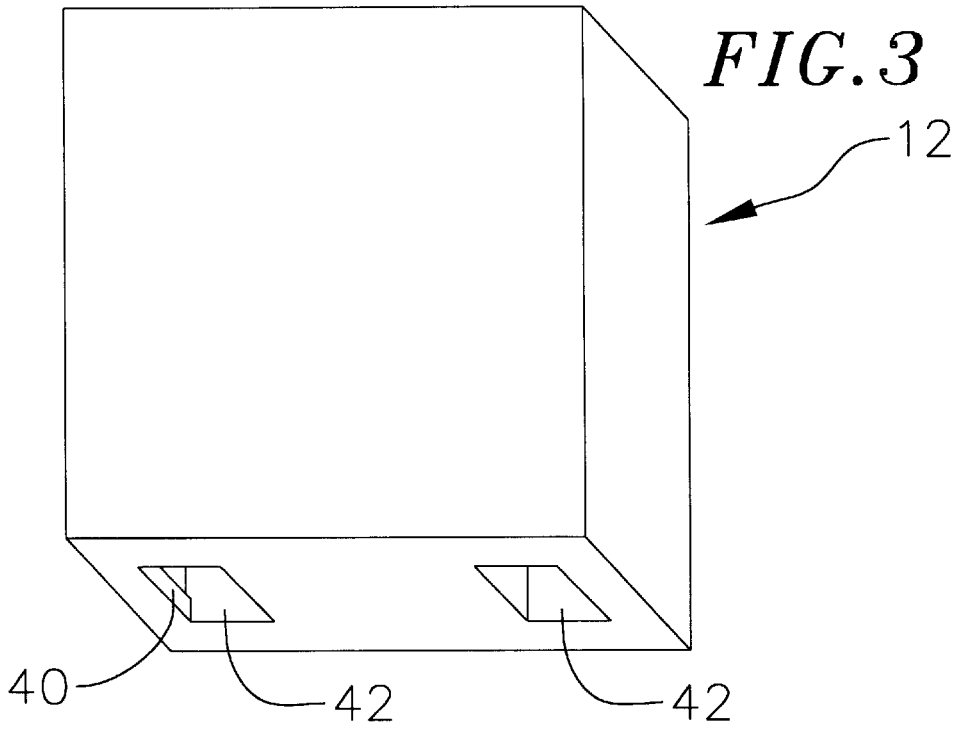
FIG. 3 is an elevated perspective view of a portion of the perimeter of an object including wells and detents according to an embodiment of the present invention.

With reference to FIGS. 3 and 5, the complimentary side of the lock is a detent 40. In one optional embodiment, the detent 40 is a lip disposed on the perimeter of a well 42 disposed on the object 12. When the prong 30 is inserted into the well 42, the deformable tab 24 is deformed inwardly as the detent 40 passes over the tab 24. As the detent 40 passes the barb 26, the deformable tab 24 is urged outward to couple to the detent 40 and thereby prevent the prong 30 from slipping from the well 42. Thus, the object 12 is removably secured to the support 10 by the coupling of the detent 40 and the tab 24.

As shown in FIGS. 2 and 5, the device of the present aspect of the invention also includes actuators 44 communicating with the deformable tab 24. These actuators 44 allow a user to readily decouple the tab 24 from the detent 40 to thereby release the object 12 from the receiver 14. In the optional embodiment shown in FIGS. 2 and 5, the actuators 44 are disposed in holes 32 through the side walls 18 of the receiver 14. The protruding ends of the actuators 44 may be depressed by a user to force the actuators 44 into contact with the tab 24. As the actuators 44 press against the tab 24, the tab 24 is deformed and the tab 24 is disengaged from the detent 40. The prong 30 is then free to slide from the well 42. Thus, the object 12 may be disengaged from the receiver 14.

With reference to FIGS. 1–5, in use, a user aligns the receiver 14 to receive at least a portion of the perimeter of the object 12 including the detent 40. A user engages the receiver 14 to the object 12 by aligning the deformable tab 24 with the detent 40. In the embodiment of FIGS. 1–5, this is facilitated by merely aligning the prong 30 and well 42. The user then presses the receiver 14 axially towards the object 12. The tab 24 is deformed as the detent 40 slides past the barb 26. When the detent 40 passes the barb 26, the tab 24 is urged outwardly such that the tab 24 engages the detent 40. With the tab 24 thus coupled to the detent 40, the object 12 is releaseably secured to the receiver 14. To release the object 12, the actuators 44 are depressed to deform the tab 24. As the tab 24 is deformed, the tab 24 decouples from the detent 40. With the tab 24 thus disengaged from the detent 40, the object 12 may be removed from the receiver 14.

Figure 6:
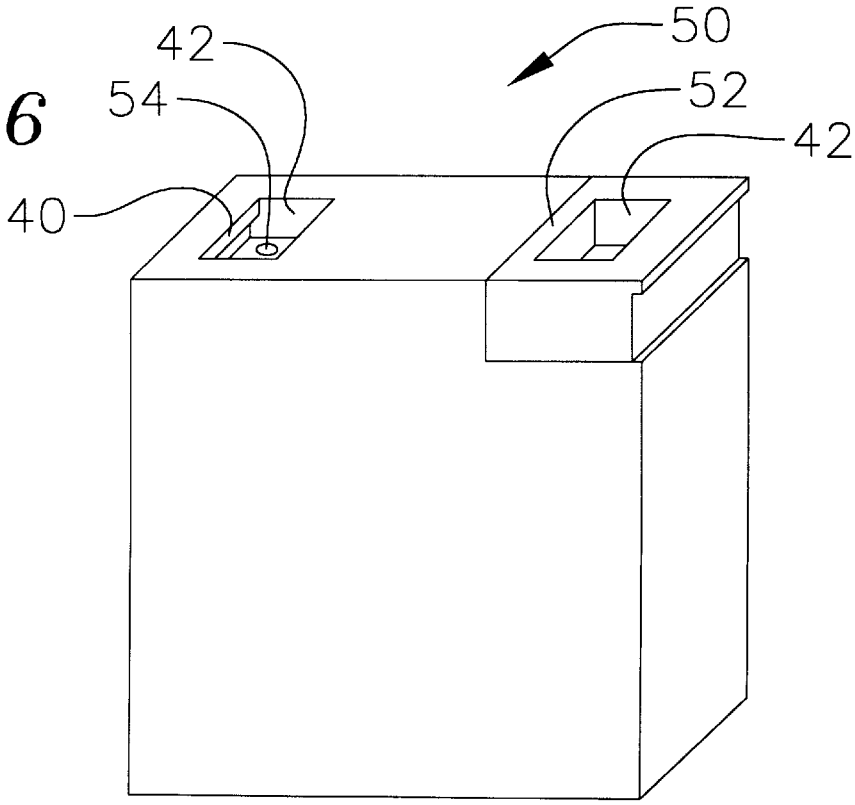
FIG. 6 is an elevated perspective view of a cigarette lighter including wells and detents according to an embodiment of the present invention.

In an alternate aspect of the present invention, a support 10 includes a receiver 14 which engages a portion of the perimeter of a cigarette lighter 50, as shown in FIG. 6, having a gas lever 52 which releases fuel through a gas port 54 and an ignitor 52 (such as a striker wheel or an electric ignitor), to secure the cigarette lighter 50 from child tampering or accidental ignition. As shown in FIG. 6, the ignitor 52 and gas lever 52 are a single part. However, the present invention may be adapted for cigarette lighters 50 which include a separate ignitor 52 and gas lever 52.

It is contemplated that the aspect of the device described above, and shown in FIGS. 1–5 may be used with a cigarette lighter 50. However, in this alternate aspect of the invention, the support 10 provides the additional function of securing the cigarette lighter 50 from child tampering or accidental ignition. In fact, it is contemplated that a support 10 could be reversible and, thus, embody both aspects of the invention simultaneously. That is, a support 10 could couple to either the bottom of a cigarette lighter 50, in the fashion described above, or to top of a cigarette lighter 50 to provide the safety function, as is described hereinafter. Moreover, it is contemplated that the support 10 of the present invention may be used to supplement safety devices known in the art or, alternatively, replace such safety devices.

Referring again to FIGS. 1 and 2, the support 10 includes a receiver 14. The receiver 14 may be of any shape, but in an optional embodiment, the receiver 14 has a shape complimentary to the surface of the cigarette lighter 50 which it is contacting so that the receiver 14 lies flush when the receiver 14 receives at least a portion of the surface perimeter of the object 12. In the embodiment of FIG. 1 and 2, the receiver 14 includes a base 16 and side walls 18 to define a substantially rectangular cup-shape to engage a substantially rectangular parallelepiped cigarette lighter 50. Of course, if the cigarette lighter 50 is not a rectangular parallelepiped, the receiver 14 may have a different shape. To prevent tampering or accidental ignition of the cigarette lighter 50, the support 10 has a shape and location such that the support 10 covers the portion of the perimeter including the gas lever 52 of the cigarette lighter 50. Optionally, the support 10 may additionally cover the gas port 54 or ignitor 52 of the cigarette lighter 50 whether the ignitor 52 is a striker wheel or an electric ignitor.

Again, the support 10 may optionally be connected to a fob, tether, key ring, key chain, or the like. Such articles may be connected to the support 10 via an eyelet 20, rivet, link, or may be integrally formed with the support 10.

The support 10 includes a lock which allows the receiver 14 to be removably secured to at least a portion of the perimeter of the cigarette lighter 50. While any number of locks could be used, the embodiment of FIGS. 1 and 2 utilizes two locks. One side of the lock is disposed on the receiver 14 and the complimentary side of the lock is disposed on the cigarette lighter 50. As shown in FIGS. 1 and 2, one side of the lock is a deformable tab 24 disposed on the receiver 14. While the deformable tab 24 could take a variety of forms, in one optional embodiment of the present invention, the deformable tab 24 includes a barb 26 disposed at the end of a thin deformable ply 28. The deformable tab 24 is biased outwardly to engage a detent 40 on the cigarette lighter 50 as will be described below. While the deformable tab 24 may be positioned in a variety of ways, in an optional embodiment, the deformable tab 24 is disposed on a prong 30 extending from the receiver 14.

With reference to FIG. 6, the complimentary side of the lock is a detent 40. In one optional embodiment, the detent 40 is a lip disposed on the perimeter of a well 42 disposed on the cigarette lighter 50. In this aspect of the invention, the well 42 is positioned such that the support 10 covers the gas lever 52 of the cigarette lighter 50 when the receiver 14 is coupled to the cigarette lighter 50 as discussed below. In the particular optional embodiment shown in FIG. 6, the wells 42 are disposed on the gas lever 52 and over the gas port 54. When the prong 30 is inserted into the well 42, the deformable tab 24 is deformed inwardly as the detent 40 passes over the tab 24. As the detent 40 passes the barb 26, the deformable tab 24 is urged outward to couple to the detent 40 and thereby prevent the prong 30 from slipping from the well 42. Thus, the cigarette lighter 50 is removably secured to the support 10 by the coupling of the detent 40 and the tab 24 thereby covering the gas lever 52 and securing the gas lever 52 from being depressed. In an optional embodiment, the support 10 may additionally cover the gas port 54, the ignitor 52, such as a striker wheel or electric ignitor, or both to provide additional safety features.

As shown in FIGS. 1 and 2, the device of the present aspect of the invention also includes actuators 44 communicating with the deformable tab 24. These actuators 44 allow a user to readily decouple the tab 24 from the detent 40 to thereby release the cigarette lighter 50 from the receiver 14. In the optional embodiment shown in FIGS. 1 and 2, the actuators 44 are disposed in holes 32 through the side walls 18 of the receiver 14. The protruding ends of the actuators 44 may be depressed by a user to force the actuators 44 into contact with the tab 24. As the actuators 44 press against the tab 24, the tab 24 is deformed and the tab 24 is disengaged from the detent 40. The prong 30 is then free to slide from the well 42. Thus, the cigarette lighter 50 may be disengaged from the receiver 14.

With reference to FIGS. 1, 2, and 6, in use, a user secures the cigarette lighter 50 from child tampering and accidental ignition by aligning the receiver 14 to receive at least a portion of the perimeter of the object 12 including the detent 40, the gas lever 52, and, in an optional embodiment, the gas port 54 and the ignitor 52. A user engages the receiver 14 to the cigarette lighter 50 by coupling the deformable tab 24 with the detent 40. In the embodiment of FIGS. 1, 2, and 6, this is facilitated by merely aligning the prong 30 and well 42 and pressing the receiver 14 axially towards the cigarette lighter 50. The tab 24 is deformed as the detent 40 slides past the barb 26. When the detent 40 passes the barb 26, the tab 24 is urged outwardly such that the tab 24 engages the detent 40. With the tab 24 thus coupled to the detent 40, the cigarette lighter 50 is releaseably secured to the receiver 14 with the gas lever 52 of the cigarette lighter 50 covered. Thus, the parts of the cigarette lighter 50 which are required to ignite a flame, namely the gas lever 52 and, in an optional embodiment, the gas port 54 and the ignitor 52, are secured from being actuated and hidden from a child's view. Moreover, if a fob, tether, key ring, key chain, or the like is attached to the support 10, the cigarette lighter 50 is more likely to be maintained on the person of the user and, thus, less likely to be in a place where a child may have access to the cigarette lighter 50. To release the cigarette lighter 50 for use, the actuators 44 are depressed to deform the tab 24. As the tab 24 is deformed, the tab 24 decouples from the detent 40. With the tab 24 thus disengaged from the detent 40, the cigarette lighter 50 may be removed from the receiver 14 and the gas lever 52 may be accessed.

While certain embodiments of the present invention have been shown and described it is to be understood that the present invention is subject to many modifications and changes without departing from the spirit and scope of the claims presented herein.

We claim:

1. A device for removably securing an object to a support, said object including at least one detent, the device comprising:

a support, said support including a receiver to receive a portion of the perimeter of the object including the detent;

a deformable tab disposed on said receiver to be received by the detent, said tab coupling to said detent to removably secure said object to said support; and an actuator engaging said deformable tab, whereby said actuator deforms said tab to decouple said tab from said detent when actuated.

2. The device of claim 1 wherein said deformable tab is disposed on a prong.

3. The device of claim 2 wherein said detent is a lip on a well, said well shaped to receive said prong.

4. The device of claim 1 wherein said support is coupled to a key chain.

5. The device of claim 1 wherein said support is coupled to a tether.

6. The device of claim 1 wherein said receiver includes a base and side walls to define a substantially cup-shaped receiver.

7. A device for removably securing a safety support to a cigarette lighter having an gas lever, a gas port, an ignitor, and at least one detent comprising:

a support, said support including a receiver to receive a portion of the perimeter of the cigarette lighter including the detent and gas lever;

a deformable tab disposed on said receiver to be received by the detent, said tab coupling to said detent to removably secure said cigarette lighter to said support; and an actuator engaging said deformable tab, whereby said actuator deforms said tab to decouple said tab from said detent when actuated.

8. The device of claim 7 wherein said deformable tab is disposed on a prong.

9. The device of claim 8 wherein said detent is a lip on a well, said well shaped to receive said prong.

10. The device of claim 7 wherein said receiver includes a base and side walls to define a substantially cup-shaped receiver.

11. The device of claim 10 wherein said support is coupled to a key chain.

12. The device of claim 10 wherein said support is coupled to a tether.

13. The device of claim 10 wherein said support additionally substantially covers said gas port of said cigarette lighter.

14. The device of claim 10 wherein said support additionally substantially covers said ignitor of said cigarette lighter.

15. A device for removably securing a safety support to a cigarette lighter having an gas lever, a gas port, an ignitor, and at least one detent disposed proximate the perimeter of a well comprising:

a support, said support including a substantially cup-shaped receiver having a base and side walls to receive a portion of the perimeter of the cigarette lighter including the detent and gas lever;

a deformable tab disposed on a prong protruding from said receiver, said tab coupling to said detent when said well receives said prong to removably secure said cigarette lighter to said support; and an actuator engaging said deformable tab, whereby said actuator deforms said tab to decouple said tab from said detent when actuated.

16. The device of claim 15 wherein said support is coupled to a key chain.

17. The device of claim 15 wherein said support is coupled to a tether.

18. The device of claim 15 wherein said support additionally substantially covers said gas port of said cigarette lighter.

19. The device of claim 15 wherein said support additionally substantially covers said ignitor of said cigarette lighter.

* * * * *